United States Patent [19]

Jeffery

[11] 4,147,448

[45] Apr. 3, 1979

[54] METHOD OF OPERATING A COMPACTION ROLLER ASSEMBLY, AND A COMPACTION ROLLER ASSEMBLY

[75] Inventor: Brian S. Jeffery, Krugersdorp, South Africa

[73] Assignee: The South African Inventions Development Corporation, Pretoria, South Africa

[21] Appl. No.: 905,610

[22] Filed: May 12, 1978

[30] Foreign Application Priority Data

| | | | |
|---|---|---|---|
| May 25, 1977 | [ZA] | South Africa | 77/3141 |
| Aug. 23, 1977 | [ZA] | South Africa | 77/5113 |
| Jan. 26, 1978 | [ZA] | South Africa | 78/0477 |

[51] Int. Cl.[2] ..... E01C 19/22

[52] U.S. Cl. ..... 404/124; 172/518; 180/24.02

[58] Field of Search ..... 404/124, 122; 172/518; 180/24.02; 280/109

[56] References Cited

U.S. PATENT DOCUMENTS

| | | | |
|---|---|---|---|
| 1,070,198 | 8/1913 | Stevens | 404/122 |
| 2,682,153 | 6/1954 | Fink | 404/122 X |
| 2,909,106 | 10/1959 | Berrange | 404/124 |
| 3,950,110 | 4/1976 | Clifford | 404/124 |
| 3,966,346 | 6/1976 | Berrange | 404/124 |

*Primary Examiner*—Nile C. Byers, Jr.
*Attorney, Agent, or Firm*—Karl W. Flocks

[57] ABSTRACT

A compaction roller assembly and a method of operating it. The assembly comprises a draw frame and a non-circular lobed compaction roller connected via its axle to the draw frame. The assembly has restraint means mounted on the frame which is slidably engageable during rolling with one or both of the roller ends, and the method involves slidingly engaging the roller ends during rolling with the restraint means, to restrain undesired movement of the roller relative to the frame.

33 Claims, 20 Drawing Figures

METHOD OF OPERATING A COMPACTION ROLLER ASSEMBLY, AND A COMPACTION ROLLER ASSEMBLY

This invention relates to a method of operating a compaction roller assembly, and it relates to a compaction roller assembly.

BACKGROUND TO THE INVENTION

Impact compaction of soil makes use of an impact roller assembly which usually comprises a draw frame and a non-circular lobed compaction roller connected via its axle to the draw frame such as to follow the draw frame when it is propelled, the draw frame being either self propelled or intended for connection to a draught vehicle. The roller, and usually the frame itself, are of robust and extremely heavy construction, having a weight of the order of several tons, so as to provide effective compaction of the underlying soil by successive impacts from the roller, imparted by virtue of its non-circular profile as it rolls along.

While impact roller assemblies provide good soil compaction, problems with the connection between the roller and frame are encountered which arise from the irregular movement of the roller. The irregular movement of the roller includes the jolting movement arising from the non-circular profile of the roller, and other irregular movements arising from uneven or sloping terrain, or from traveling along curves, turning corners, or the like.

Impact roller assemblies of the type in question must, because of the non-circular profile of the roller, provide for relative movement between the roller and frame, in a direction perpendicular to the roller axis. Various types of linkages or connections between the roller and frame have been proposed to permit this relative movement, but, in spite of attempts to make them of durable and robust construction, they suffer from damage and eventual destruction caused by the abovementioned irregular movements, i.e. any movement of the roller relative to the frame not essentially perpendicular to the roller axis. Damage and accelerated wear, arising from the same cause, also takes place to the bearins for the roller axle, and these problems are aggravated by the substantial weights of the frames and rollers involved.

These problems are present in all the impact roller assemblies of the type described known to the applicant to a greater or lesser degree, namely the assemblies of U.S. Pat. Nos. 2,909,106; 3,662,658; 3,788,757; 3,966,346 and 3,950,110; South African Pat. No. 73/2253 and South African published patent applications Nos. 73/2367 and 73/3162. Furthermore, these problems are particulary troublesome when relatively sophisticated linkages or connections between frame and roller are used to reduce the shock loads which are necessarily transmitted from the roller to the frame and draught vehicle, caused by normal movement of the roller perpendicular to its axis, as they are expensive.

The present invention has thus been made in an attempt to eliminate or at least alleviate, the above described problems.

BROAD DESCRIPTION OF THE INVENTION

According to the invention there is provided a method of operating a compaction roller assembly comprising a draw frame and a non-circular lobed compaction roller connected via its axle to the draw frame such as to follow the draw frame when the draw frame is propelled, which method comprises at least intermittently slidingly engaging at least one end of the roller during rolling of the roller as it follows the frame when the frame is being propelled by restraint means which is mounted on the frame and which engages the roller at a position spaced from the roller axis, thereby to restrain undesired movement of the roller relative to the frame.

It will be appreciated that the draw frame may be connectable to a draught vehicle or it may form part of a draught vehicle.

The purpose of restraining such undesired movement is to reduce potential damage to the connection between the roller and the frame, arising from shock loads and strain caused to the connection by the undesired movement.

In this regard "undesired movement" of the roller includes twisting of the roller whereby the roller changes its attitude relative to the frame and/or bodily movement of the roller relative to the frame in the direction of the roller axis, and this undesired movement is to be constrasted with normal movement of the roller as explained hereunder.

The restraint means may comprise a plurality of restraint members, the restraint members engaging the roller at at least two positions spaced from the roller axis. Said positions may be spaced in the direction of movement of the frame from the roller axis such that the restraint members act to restrain the roller from twisting relative to the frame and thereby departing from an attitude in which its axis is perpendicular to said direction of movement. Said positions may be vertically spaced from the roller axis such that the restraint members act to restrain the roller from twisting relative to the frame and thereby departing from an attitude in which its axis is horizontal.

It will be appreciated that the purpose of the sliding engagement is to maintain the roller in its normal operative attitude relative to the draught frame, in which the roller axis is perpendicular to the direction of movement of the frame, and in which the roller axis is horizontal. "Horizontal" in this regard refers to the usual operation of the assembly when it is used to compact a horizontal surface. Naturally, when the surface being compacted is not horizontal, for example when the assembly traverses a slope so that one end of the roller is lower than the other and one side of the frame is lower than the other, then "horizontal" means parallel to the surface being compacted, and "vertically spaced" has a corresponding meaning.

It will also be appreciated that engaging only one end of the roller at a single position will be useful in restraining such twisting of the roller relative to the frame as would tend to increase the force of engagement, but it would not help to restrain such twising as would tend to move the roller end away from the engagement. For this reason, while engaging only one end of the roller at a single position represents a substantial advance over what has been done before, it is nevertheless preferred to effect the engagement at at least two positions, for example two positions at one end of the roller, or one position at each end of the roller. These to positions will be arranged such that twisting which tends to move the roller end away from the engagement at one position will tend to increase the force of engagement at the other position, and vice versa.

With a minimum of two positions of engagement as described above, suitably arranged, the engagement can act either to restrain the roller from departing from an attitude in which it is horizontal, or from an attitude in which it is normal to the direction of movement. However, by engaging the roller ends at at least three suitably arranged positions, at least two of which are spaced from the roller axis in the direction of movement and at least two of which are vertically spaced relative to the roller axis, the engagement can restrain the roller from departing from an attitude in which its axis is perpendicular to the direction of movement, and from an attitude in which its axis is horizontal. These three positions can be at one end of the roller, or they can be arranged with at least one position at each end of the roller, and it will be appreciated that any desired number above three, suitably arranged, will achieve the same effect. It is thus preferred that the restraint members slidingly engage the roller at at least three positions spaced from the roller axis.

In use, the roller axis will normally move in a direction perpendicular to its axis relative to the frame, both in the fore and aft direction, and in a vertical direction, the limits of such normal movement being imposed by the particular geometry of the assembly in question, and such normal movement, which is necessary for proper operation of the assembly, is to be contrasted with the undesired movement defined above. The median position of the roller axis is defined as a position midway between its extreme positions of normal movement relative to the frame in a vertical direction and midway between its extreme positions of normal movement relative to the frame in the direction of movement. Thus, conveniently, and particularly when there are several positions at each end of the roller where the roller is engaged, the arrangement of the restraint members may be such that they are mounted on the frame at positions which are equally spaced from the median position of the roller axis.

The method may comprise lubricating the sliding engagement between the restraint means and the roller by means of a suitable lubricant. Such lubricant may, for example, be a layer or coating of a suitable solid lubricating material such as graphite on the restraint means, or it may be a suitable fluid lubricant. The lubricant may be a fluid lubricant having a kinematic viscosity in the range of 220–435 centistokes at 37½° C. The method may include, during rolling of the roller, at least intermittently supplying the lubricant to the engagement between the restraint means and the roller. The method may include controlling the rate of supply of lubricant by control means which is responsive to changes in the speed of rolling of the roller. Thus, for example, the rate of supply of lubricant may be proportional to the speed of rolling of the roller, so that lubricant is supplied at a faster rate when the roller is rolling quickly, than when the roller is rolling slowly. The lubricant may be fluid supplied by a metering pump.

When the lubricant is a fluid lubricant, it is conveniently a lubricating oil composition having a kinematic viscosity in the range 240–435 centistokes, measured at 37½° C. The composition should preferably be a heavy bodied, adhesive (tacky) lubricant, for example one of the open gear bitumen type. A suitable lubricant composition should preferably be capable of accepting a diluent or low temperature operation and should have a minimum Timken OK load of about 16 Kg. Thus, for example, a lubricant composition available from Mobil Oil South Africa (Proprietary) Limited under the trade designation "MOBIL TAC MM" (including mineral oil, bitumen and wax) and having a kinematic viscosity of 315 centistokes at 37½° C., is suitable. The lubricating composition should preferably have a resistance to water washing similar to that of MOBILE TAC MM; should protect against wear under a similar range of impact loads; should have a similar film adhesion to minimise throw-off; and should provide similar protection of working faces under boundary loads.

The restraint members are conveniently pads adapted to slide along the faces of the roller ends, and the lubricant is conveniently supplied through the working faces of the pads. However, although the use of pads is preferred, the term "sliding" in the specification is intended to be construed broadly to cover also the use of restraint members which roll along the end faces of the roller, instead of sliding in the fashion of a pad.

Although, as described above, it is possible to confine the restrait means to acting on one end of the roller only, it is preferred to have the restraint means acting on each end of the roller as mentioned above, so that in addition to restraining the twisting of the roller, the restraint means acts to prevent translational or bodily movement of the roller in the direction of its axis. The restraint means may thus at least intermittently engage each end of the roller.

It is also preferred, in order to prevent continuous and unnecessary engagement between the restraint means and the roller ends, when the restraint means acts on each end of the roller, to have a slight spacing between the restraint means and the roller ends of the order of about 3 mm or less. Thus the spacing between the restraint means at one end of the roller and the restraint means at the other end of the roller may be greater than the spacing between the roller ends by about 6 mm or less. Furthermore, if desired, the restraint members may be mounted on the frame in non-rigid fashion, for example on resilient mountings, so that they are capable of giving at least slightly before applying their full force of engagement, when they are struck by the roller ends in operation.

Further according to the invention there is provided a compaction roller assembly which comprises a draw frame;

a non-circular lobed compaction roller connected via its axle to the draw frame such as to follow the draw frame when the draw frame is propelled; and restraint means mounted on the frame and slidably engagable, during rolling of the roller as it follows the frame when the frame is propelled, with at least one end of the roller at a position spaced from the roller axis, thereby to restrain undesired movement of the roller relative to the frame.

The restraint means may comprise a plurality of restraint members, the restraint members being mounted on the frame and arranged so that they are engagable with the roller at at least two positions spaced from the roller axis.

Said positions may be spaced in the direction of movement of the frame from the roller axis such that the restraint members act to restrain the roller from twisting relative to the frame and thereby departing from an attitude in which its axis is perpendicular to the said direction of movement. Said positions may be vertically spaced from the roller axis such that the restraint members act to restrain the roller from twisting relative to the frame and thereby departing from an attitude in which its axis is horizontal.

There may be at least three said restraint members, engageable with the roller at different positions, and the positions of the restraint members may be equally spaced from the median position of the roller axis. By having each restraint member the same distance from the median position of the roller axis, the restraint members will tend, when slidably engaging the end or ends of the roller, to follow a more or less circular path along said roller end or ends, and when several restraint members engage the same end of the roller they will tend to follow more or less the same path along said end. There may be at least one restraint member engageable with each end of the roller.

The restraint members may be pads replaceably held in brackets on the frame, and the pads may be of mild steel, having flat working surfaces for engagement with the roller, each end of the roller which is engageable by a pad having a mild steel outer lining covering at least that part of the roller end with which the restraint member in use is engageable.

The assembly may include lubricating means for supplying a lubricant to the roller where the restraint means engages the roller. The lubricating means may comprise a metering pump for pumping the lubricant to the roller, and the metering pump may be capable of pumping a lubricant having a kinematic viscosity in the range of 220–435 centistokes. The metering pump may be of variable capacity, and the metering pump may be operatively connected to control means responsive to the speed of rolling of the roller for supplying lubricant at a faster rate when the roller is rolling quickly, than when the roller is rolling slowly. The metering pump may have its intake connected to a lubricant store mounted on the assembly.

The connection between the roller axle and the frame may comprise a pair of simple links, the links being located at opposite ends of the roller and each link having one end connected directly to the frame and having the roller axle journalled to its other end.

Each simple link may be in the form of a bar or cable.

The frame may have a pair of laterally spaced ground wheels at opposite sides of the compactor whereby the frame is supportable during roller of the roller along the ground. The roller may be movable between an operative position in which it can rest on and roll along the ground while the ground supports the wheels, and an inoperative position in which it is raised from the ground and is supported by the frame, the assembly including elevator means mounted on the frame and engageable with the roller whereby the roller is movable between its operative and inoperative positions.

The links may be trailing links extending rearwardly from their connections to the frame to their connections to the roller axle, in which case the links may comprise, as mentioned above, bars or cables.

Instead, the links may be leading links, extending forwardly from their connections to the frame to their connections to the axle, in which case the links are bars.

When the links are bars the ground wheels of the frame may be omitted, and suspension means may be provided to operate between the roller axle and the frame, by which suspension means the frame is suspended from the roller axle. Such suspension means may be pneumatic, and may comprise, at opposite ends of the roller, one or more air bags between the frame and the roller axle.

Instead the frame may have, at opposite sides thereof, a pair of laterally-spaced ground wheels whereby the frame is supportable during rolling of the roller, the frame having at opposite ends of the roller a pair of slots or recesses in which opposite ends of the roller axle are located and within the confines of which the said ends of the roller axle are constrained to move during rolling of the roller.

Said slots or recesses may be provided with liners against which the axle ends bear during rolling of the roller, and the axle ends may be provided with bearings to assist in rolling of said axle ends along said liners.

In this embodiment having the slots or recesses defined above, as in the other embodiments, care must be taken to locate the restraint means in a position where it will always remain opposed to the roller end or ends to be engageable therewith.

Instead, the frame may comprise a pair of sub-frames, one of which is adapted for connection to a draught vehicle and the other of which has opposite ends of the roller axle journalled therein, the sub-frames being vertically spaced from each other and resiliently held apart by biassing means, and the sub-frames being interconnected at each side of the assembly by a pair of pivotal links spaced in the direction of movement of the assembly, each link having its ends respectively connected to the sub-frames and the sub-frames being movable relative to each other by pivoting of the links relative to said sub-frames.

The biassing means may comprise, at each side of the frame, an arcuately curved leaf spring, the central portion of which is connected to one of the sub-frames, and opposite ends of which bear against the other sub-frame, the leaf spring being arranged so as resiliently to resist a reduction in vertical spacing between the sub-frames, and opposite ends of the leaf spring conveniently being provided with rollers whereby said ends are rollable along tracks provided therefor on the sub-frame which they engage.

In a further embodiment the connection between the roller axle and the frame may comprise a pair of links, the links being located respectively at opposite ends of the roller and each link comprising a coil spring mounted on the frame and a flexible element, the flexible elements being located respectively between the coil springs and the ends of the roller axle and the links being resiliently extensible against a bias provided by the springs.

Each flexible element may be in the form of a chain or cable, and each spring may be mounted in a housing. Each spring may be mounted on a post projecting upwardly from the frame or, if desired, the post may be omitted. Each flexible element may pass along the interior of the associated spring and may be connected to the spring, for example by a swivel, at the end of the spring remote from the roller, the opposite end of the spring being anchored to the frame or post so that extension of the link causes compression of the spring.

Each flexible element may have its end remote from the spring journalled directly to the roller axle. Instead, the flexible element may have its end remote from the spring connected to an auxiliary compound linkage, the compound linkage comprising two rigid constituent links pivotally connected together about a lateral axis, one constituent link being connected to the element and having the roller axis journalled therein, and the other constituent link being pivotally connected to the frame about a lateral axis.

When the links comprise coil springs and flexible elements as described above, the frame may be hung from the roller axis, or it may be carried on wheels. When the frame is carried on wheels, the assembly may include elevator means operable between the frame and the roller, the elevator means when inoperative permitting the roller to roll on a surface supporting the wheels, and when operative raising the roller from said surface so that the frame supports the roller. The elevator means may be hydraulic.

When the frame is hung from the roller, it may be hung from the ends of the roller axle by a suspension system in which the roller axle is journalled, the suspension system comprising one or more links extending downwardly from each end of the roller axle to the frame, and the suspension system permitting relative movement between the roller axle and frame in the direction of movement and suspending the frame resiliently from the roller axle. Furthermore, each coil spring can be replaced by a pneumatic spring having the same function, for example a pneumatic piston and cylinder assembly which is resiliently extensible and/or compressible. Furthermore, when the spring is used, each flexible element can be replaced by a rod or bar having the same function, the attachment between the rod or bar and the spring being such that extension of the links against the bias provided by the springs is permitted, and being such that contraction of the links unrestrained by a bias provided by the springs is permitted, for example by having the rods or bars slidable relative to the springs during contraction of the links after the springs have assumed their unstressed condition.

In yet another embodiment the roller may have each end of its axle located in an upwardly extending slot in a slide member, each slide member being slidable along a guide forming part of the frame, parallel to the direction of movement of the frame, the assembly including resilient stop means limiting the degree to which the slide member can slide rearwardly along its guide.

The resilient stop means may comprise a coil spring operable between the frame and slide member, the coil spring preferably being subject to compression when acting to limit the degree of rearward sliding of the slide member along the guide.

Each slide member may form a restraint member, the roller having at each of its ends a flat laterally outwardly facing surface around the axle, against which surface the associated slide member engages during rolling to keep the roller in its desired attitude, as described above. Instead, each slide member may have one or more restraint members mounted thereon.

In a yet further embodiment of the assembly the connection between the roller axle and the frame may comprise a pair of laterally spaced longitudinally extending composite links respectively at opposite ends of the roller and pivotally connected to the frame about primary pivotal axes extending laterally, each composite link comprising at least two constituent links pivotally connected together about secondary pivotal axes parallel to the primary pivotal axes, bias means to bias at least two of the constituent links of each composite link to positions in which they are at an angle to each other, and bearings for the roller on each of the composite links wherein the roller axis is journalled, the connection permitting arcuate displacement of the roller axis independently about the primary and secondary pivotal axes.

With regard to the composite links, the words "laterally" and "longitudinally" refer to the fore and aft direction of the draw frame, i.e. to the direction of intended movement of the draw frame. "Longitudinally" is parallel to said direction, and "laterally" is substantially horizontal and perpendicular to said fore and aft direction. "Independently" with reference to the arcuate displaceability of the roller axis about the primary and secondary pivotal axes means that the constituent links of the composite links can pivot relative to one another about the secondary pivotal axes, such pivoting being not necessarily accompanied by pivoting of the composite links about the primary pivotal axes, and it means that the composite links can pivot about the primary pivotal axes, such pivoting being not necessarily accompanied by pivoting of the constituent links of the composite links relative to one another about the secondary pivotal axes.

The connection between the roller axle and the frame may include joint means which permits twisting of the roller relative to the frame to vary its attitude relative to the frame, within the constraints to such twisting imposed by the restraint means.

When the connection between the frame and roller comprises composite links as described above, the connection may include, associated with the composite links, a pair of laterally spaced compound auxiliary linkages, one at each end of the roller. Each auxiliary linkage is preferably a trailing linkage comprising a pair of rigid auxiliary links pivotally connected together about a lateral axis, the front auxiliary link being connected to the frame about a lateral axis and the rear auxiliary link having the roller bearing journalled thereon and forming part of the associated composite link furthermost from the frame.

When the joint means forms part of a connection comprising auxiliary linkage and composite links as described above, the joint means may be of a type permitting pivoting about a substantially laterally extending axis while permitting the attitude of said axis to vary as regards its inclination both to the direction of movement and to the vertical. In this regard it will be appreciated that the axis of the joint is usually horizontal and perpendicular to the direction of movement during normal operation. The joint means thus permits said axis, and the roller axis, to depart, in response to movements of the roller caused by rolling over the ground, from their usual attitudes, within the limits imposed by the restraint means.

The joint means may be provided on the auxiliary linkages, and each auxiliary linkage may have two of said joint means. At least one joint means may comprise a swivel- or univeral-type joint, for example a ball-and-socket-type joint; and at least one joint means may comprise resiliently flexible material, the swivelling action and/or flexibility of the joint means permitting the twisting and variation in attitude between the roller axis and the frame.

The swivel- or universal-type joint conveniently comprises a pin having a convex part-spherical outwardly directed working surface journalled in a bearing having a correspondingly part-spherical concave working surface engaging the working surface of the pin, ball-and-socket fashion. Pivoting of the pin about its axis is thus permitted, together with variation of the attitude of said pin relative to the bearing.

The joint means including resiliently flexible material may comprise a pin having a convex cylindrical working surface journalled in a bearing having a correspondingly concve cylindrical working surface, the bearing being mounted on resilient material, for example a body of resiliently flexible material such as rubber, which surrounds the bearing. Pivoting of the pin about its axis is thus permitted, together with variation of the attitude of the working surfaces of the bearing and in relative to the mounting of the resilient material, the resiliently flexible material flexing to permit this variation.

When the auxiliary linkage is absent and the composite links have rigid constituent links, the joint means may form part of the composite links. When the auxiliary links are present, one or more constituent links of each composite link may be flexible, for example by being a cable or chain. Each swivel-type joint may then be provided at the pivotal axis between each connected pair of auxiliary links, and the joint means having the resiliently flexible material may be provided at the pivotal connection between each auxiliary linkage and the frame.

BRIEF DESCRIPTION OF THE DRAWING

The invention will now be described, by way of example, with reference to the accompanying diagrammatic drawings.

In the drawings.

DETAILED DESCRIPTION OF THE INVENTION

Figure 1:
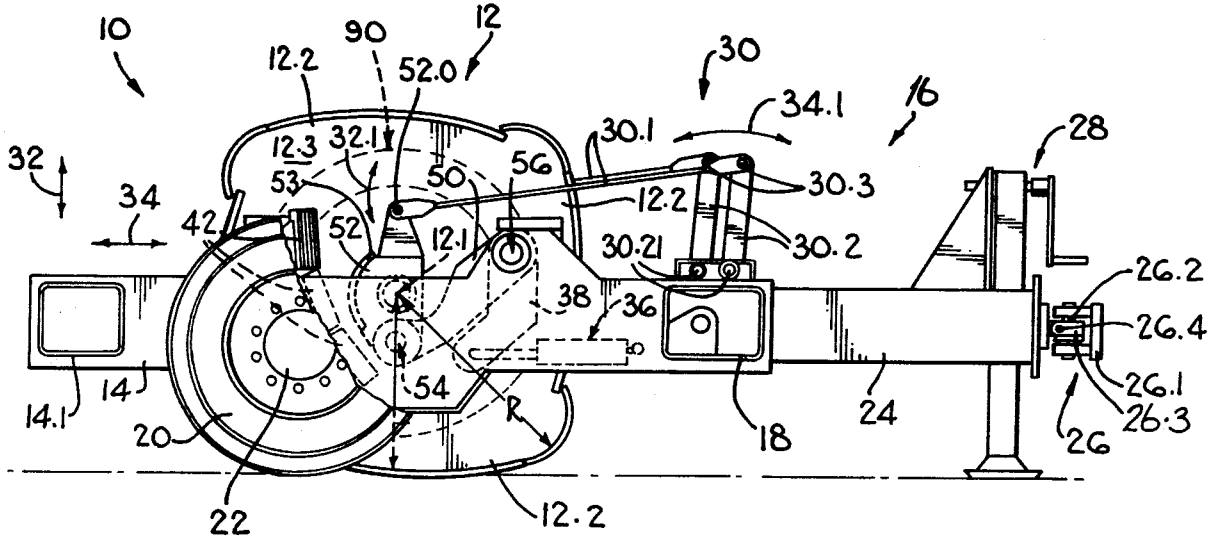
FIG. 1 shows a diagrammatic side elevation of a compaction roller assembly having a multi-lobed non-circular compaction roller mounted according to one embodiment of the invention.
Figure 2:
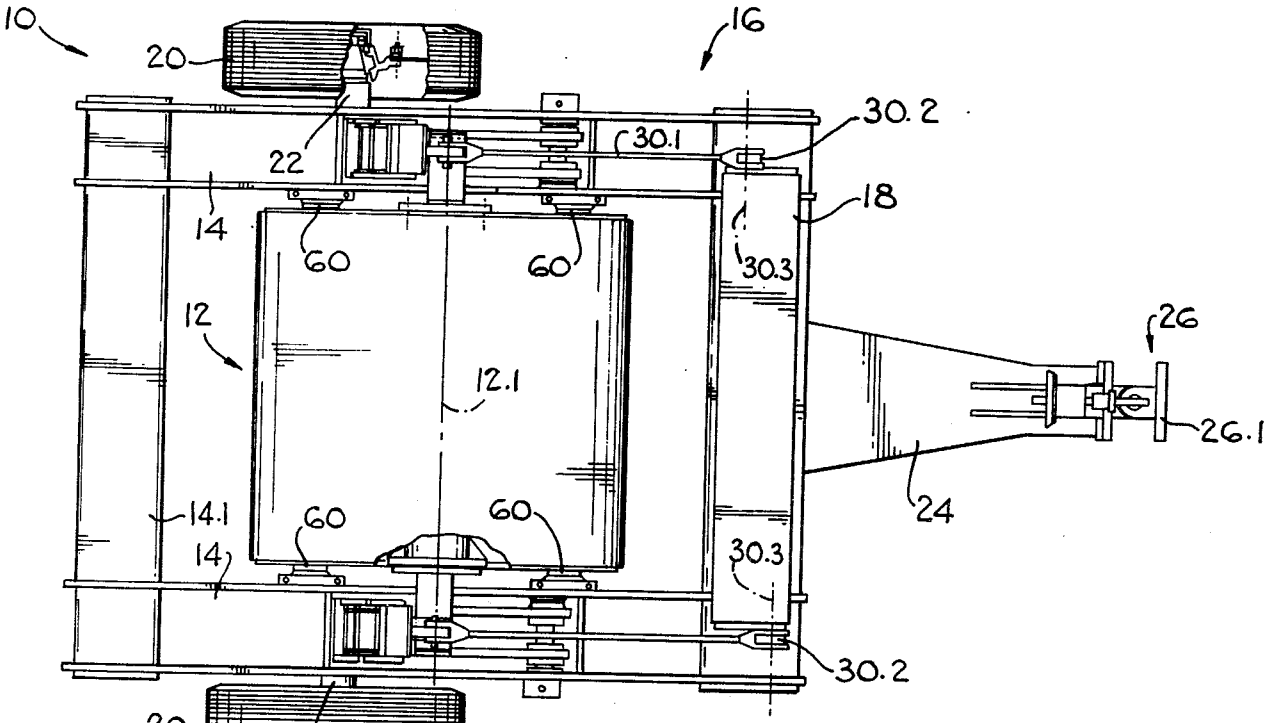
FIG. 2 shows a plan view of the assembly of FIG. 1.
Figure 3:
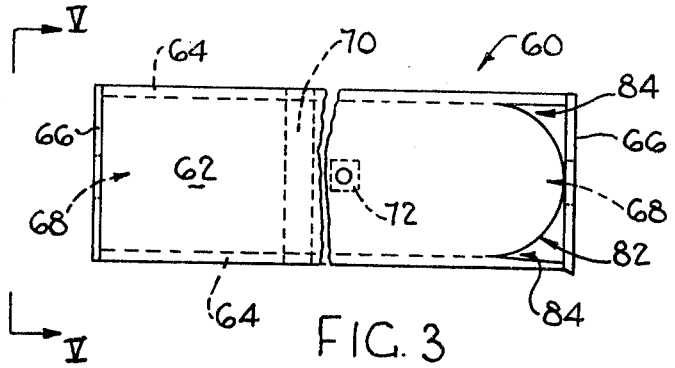
FIG. 3 shows a plan view of a restraint pad for the assembly of FIG. 1.
Figure 4:
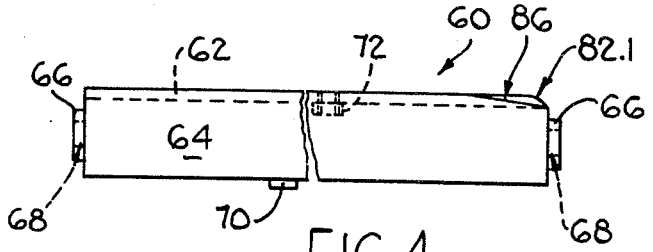
FIG. 4 shows a side elevation of the pad of FIG. 3.
Figure 5:
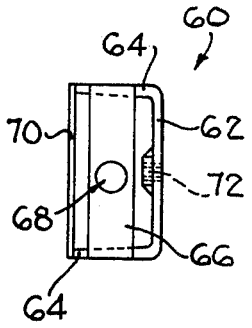
FIG. 5 shows an end elevation of the pad of FIG. 3 in the direction of line V—V in FIG. 3.

Referring particularly to FIGS. 1 and 2 of the drawings, reference numeral 10 refers generally to a compaction roller assembly in accordance with the invention, comprising a multi-lobed non-circular compaction roller 12 having a rotational axis 12.1 and lobes 12.2. The roller 12 is mounted rotatably between laterally spaced trailing arms 14 on a draw frame, generally indicated by reference numeral 16. The frame 16 comprises generally a transverse member 18 extending parallel to the rotational axis 12.1 of the roller. From positions at or near the ends of the transverse member 18 the arms 14 extend rearwardly on opposite sides of the roller 12. Towards the trailing ends of the arms 14, which are connected by a cross member 14.1, there are provided wheels 20 rotatably mounted on stub axles 22 secured to the arms 14.

At the middle of the transverse member 18, and extending forwardly, there is provided a tongue-like projection 24 at the front end of which there is provided connection means 26 for connection to a draught vehicle. The means 26 includes a plate 26.1 for bolting to the draufht vehicle, and a pin 26.2 journalled in an eye 26.3 to permit pivoting of the frame 16 relative to the draught vehicle about an upwardly extending axis. The front end of the projection also includes a horizontal transversely extending pivot axis 26.4 which permits pivoting of the frame 16 relative to the draught vehicle about a horizontal transverse axis. Pivoting about the axis 26.4 and about the vertical axis of the pin 26.2 thus provides a universal-type joint between the frame 16 and the draught vehicle. Also provided at the front end of the projection 24, is a foldable or removable supporting jack 28 for supporting the projection 24 while the roller 12 is not in use.

The tractive connection between the roller 12 and the frame 16 is by means of a pair of trailing composite links 30 for transmitting traction from the frame 16 to the roller 12. The links 30 are pivotally connected to the frame 16 about primary axes 30.21. This arrangement permits freedom of movement of the axis 12.1 of the roller 12 while it is rolling in operation relative to the frame 16 in the direction of arrows 32 and 34.

Each composite link 30 comprises constituent links, namely a flexible rear link 30.1 in the form of a cable and a rigid front link 30.2 pivotally connected together about a secondary axis 30.3 parallel to the rotational axis 12.1 of the roller. The front link 30.2 is pivotally connected at its lower end about the primary axis 30.21 to the frame, and extends upwardly therefrom. The link 30.2 is biassed to a position inclined at an angle to link 30.1 by means of a torsion bar co-axial with and defining the primary lower pivotal axis 30.21.

The torsion bar is supported pivotally at one end adjacent its connection to the link 30.2 by the frame 16 and is held fast against rotation or pivoting at its opposite end, also by the frame 16.

The composite link 30 has been described for one side of the roller 12. It will be understood that a similar construction of composite link with torsion bar is provided for the other end of the roller 12, the torsion bars of the composite links being parallel and closely spaced from each other. It will be noted, however, that the links 30.2 are mounted slightly spaced in the direction of arrow 34 from each other. This is to ensure that the tension bars can be alongside each other so that a maximum length of torsion bar can be utilized. If the torsion bars are mounted co-axially and end-to-end, then torsion bars of only about half the length permitted by having them alongside each other would be possible. For clarity of the drawings, the spacing in the direction of arrow 34 between the links 30.2 in the fore and aft direction is exaggerated.

Lateral guidance of the roller by the frame is provided by the composite links and also by a pair of compound auxiliary linkages. Each auxiliary linkage comprises two rigid auxiliary constituent links, namely links 50 and 52. Links 50 and 52 are pivotally connected together about a lateral axis defined by a pin 54, the axis of the pin 54 being substantially parallel to the rotational axis 12.1 of the roller. The axis 12.1 of the roller is rotatably journalled in bearings carried by links 52. The leading end of each link 50 is pivotally connected about a lateral axis 56 to the associated arm 14 of the frame 16, the axis 56 also being substantially parallel to the rotational axis 12.1 of the roller. Each link 30.1 is pivotally connected to the associated link 52 about an axis 52.0 which is spaced above but parallel to the axis 12.1 of the roller, which axis 12.1 is connected to the link 52. Thus, the roller 12 is connected swingletree fashion to the frame 16 via the link 50 and via connecting links 52, 30.1, and 30.2, and the torsion bar which has its axis co-axial with axis 30.21. Similar linking arrangements are provided at both ends of the roller 12.

The assembly 10 further includes elevator means, indicated by reference numeral 36, which comprises a pair of hydraulically operable plunger and cylinder assemblies, one assembly mounted on each arm 14 and coacting with a lever 38 mounted on the arm and pivotable about a pin having its axis parallel to the axis 12.1 and located at 56. The elevator means is adapted to raise the roller 12 into such a position that its lobes 12.2 are out of contact with the ground so that the roller may be transported in its frame, which is itself supported by the wheels 20. The assemblies 36 are extensible to bear upwardly via the levers 38 against abutments provided by the auxiliary constituent links 50 to raise the roller.

In operation a draught vehicle will be attached to the impact roller assembly at the connection means 26. When the assembly starts moving, the axis 12.1 of the roller will move in an up and down fashion to deliver impacts via the lobes 12.2 to the ground, thereby compacting the ground. The movement in a vertical direction of the axis 12.1 is determined by the difference between the maximum and minimum radii of the roller, namely R and r. In operation, freedom of movement, subject to gravity, of the roller 12 relative to the frame 16, is permitted along an upwardly extending path, by arcuate movement of the trailing ends of the links 30.1 in the direction of arrow 32.1 about the axis 30.3. This arcuate movement in the direction of arrow 32.1 of the trailing end of the links 30.1 provides the vertical freedom of movement of the axis 12.1 in the direction of arrow 32 referred to above. Likewise, horizontal freedom of movement backwards and forwards, as indicated by arrow 34, of the axis 12.1 of the roller relative to the frame 16, is provided by arcuate movement in the direction of arrow 34.1 of the secondary pivotal axes 30.3 at the upper ends of the links 30.2 when the links 30.2 pivot in resiliently damped fashion about the primary axes 30.21 of the torsion bars relative to the frame. The torsion bars act to permit resiliently damped freedom of movement of the roller in opposite directions relative to the frame along the direction of rolling shown by arrow 34.

For lateral guidance of the roller 12 within the frame 16, reliance is placed partially upon the links 50 and 52 which are strong and robust and act as guide means to resist the bending forces imposed upon them by the heavy roller 12 during operation, particularly when turning. The composite links 30 also act partially to guide the roller 12.

A buffer stop 42 is provided in each arm 14 for abutting against the link 52 to prevent constituent links 30.1 and 30.2 from becoming aligned parallel and end-to-end, and to prevent overstraining of the torsion bars or damage in the event of breakage of the composite links. Each link has a shield or abutment plate 53 fast therewith for engagement with its buffer stop 42.

Restraint pads 60 are provided on the arms 14, in front and behind the axis 12.1 respectively, to assist in causing the roller 12 to follow the draught vehicle, and act as primary guide means for the roller. These restraint pads, in the embodiment of FIGS. 1 and 2, are located principally to keep the roller axis 12.1 normal to the direction of haul, as shown by arrow 34, and in fact have only a small effect in keeping the roller axis 12.1 horizontal. These restraint pads and their function will also be described with reference to FIGS. 3 to 6, in which they are generally designated 60, like reference numerals being used unless otherwise specified.

Each restraint pad 60 comprises a mild steel channel section having a floor 62 and side walls 64. Opposing end edges of the side walls 64 are interconnected by flat bars 66 each having a central opening 68. A similar bar 70 having no opening interconnects the longitudinal free edges of the side walls 64, about midway along their lengths. A threaded socket connection 72 is provided centrally positioned in the floor 62 and provides a passage through said floor.

Figure 6:
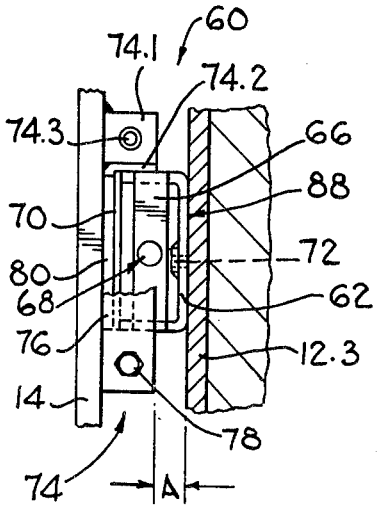
FIG. 6 shows a detail in plan view of the mounting of one of the pads of FIG. 3 on the assembly of FIG. 1.

With reference to FIG. 6 each pad 60 is located in position by a U-shaped bracket 74 formed from a bent metal bar the side of which is welded to the associated arm 14 of the frame. The U of the bracket 74 has limbs 74.1 and a base 74.2. The free ends of the limbs 74.1 have tapped socket 74.3 and a rod or bar 76 is bolted thereto by bolts 78. Part of the bar 76 and a single bolt 78 are shown, so that the socket 74.3 in the other limb 74.1 is exposed in end elevation at its end remote from the base 74.2. The brackets 74 are located on the arms 14 so that they face, and are spaced by spacing A, which is 35mm, from, the end wall of the roller 12 which is clad by a mild steel lining 12.3. The base 74.2 of each U is lowermost.

To insert the pad 60 in its bracket 74, the bar 76 is removed and the pad 60 is slid in between the free ends of the limbs 74.1, between the arm 14 and lining 12.3, together with a rubber backing pad 80. The bar 76 is then replaced.

The leading end of each pad, i.e. that which is approached by the rotating lining 12.3 of the roller 12, has the floor 62 cut away to form a convexly curved leading edge 82 which is radiused as at 82.1. From the corners 84 between said edge 82 and the side walls 64, the side walls 64 taper in depth as at 86 towards their free ends.

In use, the sockets 72 are connected by hoses passing through one of the openings 68 in a bar 66 to a variable capacity metering pump (not shown) adapted to deliver a lubricant such as Mobil Tac MM, at a desired rate to the interface at 88 where the outer surface of the floor 62 and the lining 12.3 are in contact. Lubricant so delivered is deposited on a band or path 90 (FIG. 1) on the lining 12.3 and direct rubbing or sliding contact between the pads 60 and lining 12.3 is thus reduced or eliminated. Sliding engagement between the pads 60 and lining 12.3 via a layer of lubricant along the path 90 assisted by the various links between the roller 12 and frame 16, maintains the roller axis 12.1 normal to the direction of haul or movement shown by arrow 34 and acts to a lesser degree (as there is contact only over the lengths of the pads) to keep the axis 12.1 horizontal. In this regard it will be appreciated that the backing pad 80, together with rocking of the pad 60 about the bar 70 permits the floor 62 of the pad to adjust for small misalignments and to remain flat against the lining 12.3.

Figure 7:
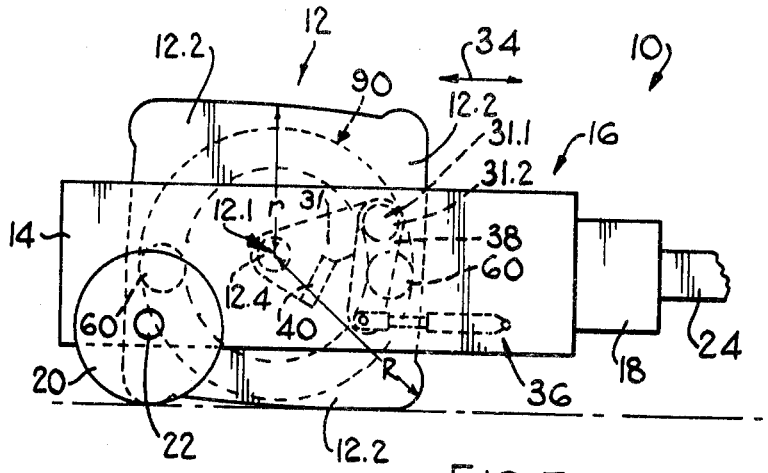
FIG. 7 shows a diagrammatic side elevation of a compaction roller assembly having a multi-lobed non-circular compaction roller mounted according to another embodiment of the invention.
Figure 8:
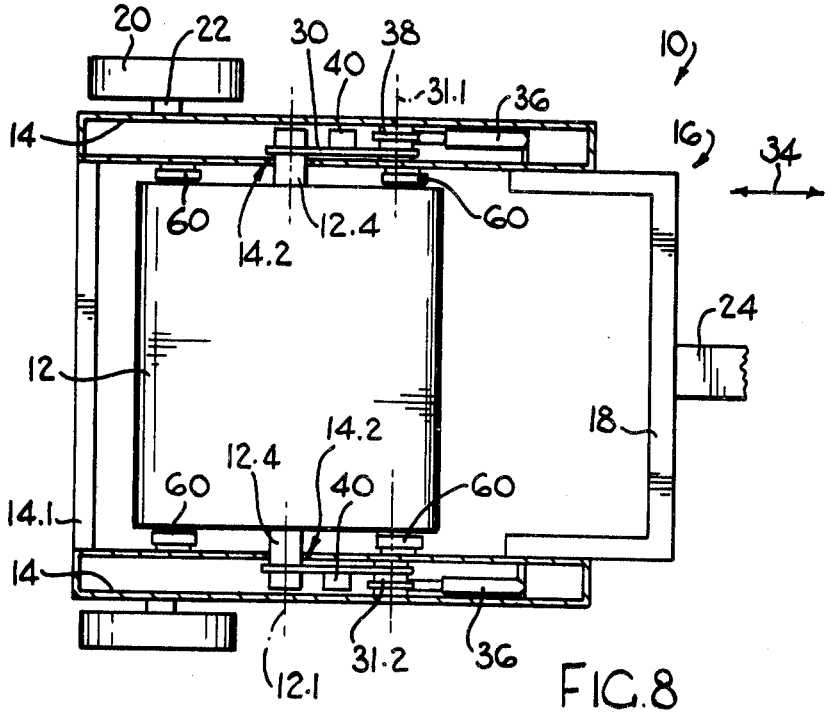
FIG. 8 shows a plan view of the roller of FIG. 7.

In FIGS. 7 and 8, unless otherwise specified, like reference numerals are used for like parts.

In FIG. 7 and 8, the tractive connection between the roller 12 and the frame 16 is by means of a pair of trailing simple links 31 for transmitting traction from the frame 16 to the roller 12. The links 31 are pivotally connected at their leading ends to the frame about a pivot axis 31.1. The links 31 are respectively located within the arms 14 which are of hollow box-section construction, the roller axis 12.1 being defined by a pair of stub axles 12.4 journalled respectively in the trailing ends of the links 31. The stub axles 12.4 project into the interiors of the arms 14 via arcuate upwardly extending slots 14.2 (only shown in FIG. 8) in the walls of said arms 14, said slots being curved about pivot axes 31.1.

The assembly 10 further includes elevator means generally indicated by reference numeral 36, which comprises a pair of hydraulically operable plunger and cylinder assemblies, one assembly mounted in each arm 14 and co-acting with a lever 38 mounted on the associated arm and pivotable about a pin 31.2 having its axis coaxial with and defining the pivot axis 31.1. This elevator means is adapted to raise the roller 12 upon extension of the assemblies 36 into such a position that its lobes 12.2 are out of contact with the ground so that the roller may be transported in its frame 14, supported by the wheels 20. The assemblies 36 are extensible to bear rearwardly via the levers 38 against abutments 40 provided on links 31, thereby to raise the roller by pivoting the links 31 upwardly about the axes 31.1.

In operation a draught vehicle will be attached to the impact roller assembly 10 at connection means, similar to the connection means 26 of FIGS. 1 and 2, on the projection 24. When the assembly starts moving, the axis 12.1 of the roller will move in an up and down fashion, thereby compacting the ground, in the same way as the assembly of FIGS. 1 and 2. During compaction the frame 16 runs on the wheels 20 and the links 31 pull the roller 12, the links 31 pivoting about the axes 31.1 as the axis 12.1 moves up and down.

The construction, arrangement and function of the restraint pads in FIGS. 7 and 8 are substantially the same as described for FIGS. 1 to 6.

In FIG. 9, again unless otherwise specified, the same reference numerals are used. The roller 12 and frame 16 (which also has a cross-member 14.1 as shown in FIG. 8) are substantially the same as the roller 12 and frame 16 shown in FIGS. 7 and 8. The construction, arrangement and function of the restraint pads 60 are also substantially the same as described with reference to FIGS. 1 to 6.

Figure 9:
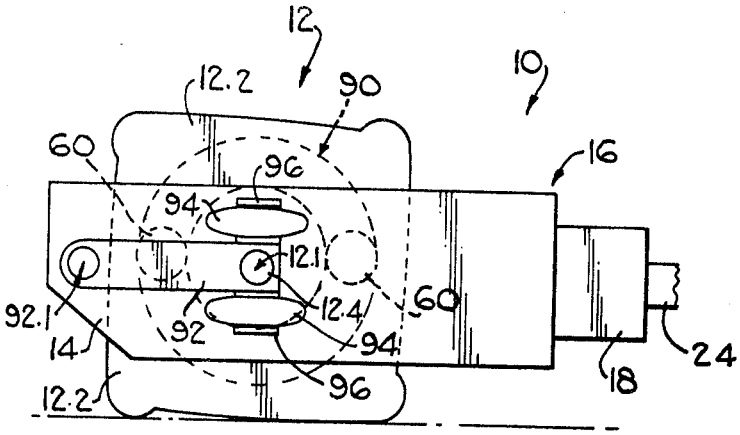
FIG. 9 shows a side elevation another embodiment of a compaction roller assembly in accordance with the invention.

The assembly 10 to FIG. 9 differs from the assembly of FIGS. 7 and 8 in that, instead of trailing links 31, a pair of leading links 92 is shown extending forwardly from pivotal connections to the rear of the respective arms 14, at which connections they are pivotable respectively about lateral pivot axes 92.1. The front ends of the links 92 have the roller stub axles 12.4 journalled therein, and pneumatic suspension means is provided between the arms 14 of the frame 16 and the roller stub axles 12.4.

The pneumatic suspension means comprises, for each link 92, a pair of air bags 94. The air bags 94 are located respectively above and below the associated stub axle 12.4 between the front end of the associated link 92 and a pair of platforms 96 respectively fast with the associated arm 14 of the frame 16.

Each upper air bag 94 (and if desired also the lower air bags 94) is connected to, or adapted for connection to, a source of air under pressure (not shown) located on the assembly 10 or on a draught vehicle intended for hauling the assembly 10, means being provided to vary the air pressure in at least the upper bags 94, while the assembly 10 is stationary or rolling. Each lower air bag 94 (and if desired also the upper air bags) is provided with a pressure relief valve (not shown).

In use while rolling, the frame 16 is supported from the roller stub axles 12.4 by the suspension means constituted by the upper air bags 94. The cross-member 14.1 of the frame is hollow, and is provided with means whereby liquid or particulate ballast may be charged therein, thereby to vary the location of the centre of gravity of the frame 16 in a fore and aft direction. In use the centre of gravity of the frame 16 is located as close as possible to a position in which it is intersected by a vertical plane passing through the roller axis 12.1. It will be appreciated that the upper air bags 94 cushion raising of the frame in response to periodic rises of the roller axis 12.1, and lower air bags 94 in turn cushion sudden lowerings of the frame which occur in response to sudden drops of the roller axis 12.1. In use the pressure in the air bags 94 will be varied as desired, to compensate for varying speeds of operation and changes in the ground surface being compacted.

The further operation of the assembly 10 in FIG. 9, in particular the operation of the restraint pads 60, is substantially the same as that described with reference to FIGS. 7 and 8 of the drawings, except that with the construction shown in FIG. 9 there is naturally no raising of the frame on elevator means.

Figure 10:
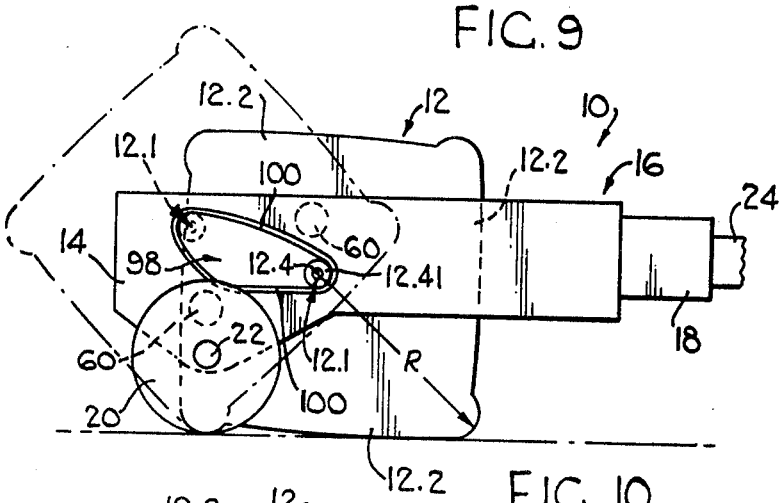
FIG. 10 shows in side elevation yet another embodiment of a compaction roller assembly in accordance with the invention.

In FIG. 10 of the drawings, once again, unless otherwise specified, like reference numerals refer to like parts. The frame 16 is shown as a wheeled frame similar to that of FIGS. 7 and 8, but instead of having the roller stub axles 12.4 connected by links to the arms 14 of the frame 16, said stub axles are adapted to roll along slots 98 provided in said arms 14. Each slot 98 is in the form of a roughly triangular opening through the associated arm 14 which opening is elongate having two pointed ends and two convexly curved sides extending between said pointed ends. A line passing through the pointed ends extends upwardly and rearwardly so that there is a front lower pointed end and a rear upper pointed end. The edges of the slots or openings are reinforced by means of liners 100 defining the periphery thereof. The part of each stub axle 12.4 which projects into the associated slot 98 is provided with a roller bearing 12.41 adapted to roll along the liner 100.

The forward portion of the lower side of the periphery 100 of each slot 98 is substantially horizontal, and extends rearwardly from the front lower pointed end to a position where it curves upwardly toward the rear upper pointed end, where it is substantially vertical. The upper portion of said periphery 100 is substantially arcuately curved, having a radius substantially equal to the major radius R of the roller 12.

When the assembly 10 shown in FIG. 10 is stationary, the frame 16 and roller 12 will be in a position corresponding to the position shown in solid lines in FIG. 10, with the stub axles 12.4 and bearings 12.41 at substantially the same elevation as the upper surface of the horizontal portion of the lower side of the periphery 100 of the slots 98. The stub axles 12.4 and bearings 12.41 may be, depending on the nature of the ground, located slightly above said horizontal portions, or they may rest relatively lightly on said horizontal portions.

As the frame 16 is drawn forwardly at start-up by a draught vehicle, said horizontal portions are drawn forwardly under the stub axles 12.4, without moving the roller 12. As the stub axles 12.4 reach the upwardly and rearwardly sloping curved portions of the lower sides of the periphery of the slot 98, said periphery via the liner 100 urges said stub axle upwardly and forwardly, thereby rotating the roller about the front lower corner of the roller until the roller assumes the position of maximum elevation shown in broken lines in FIG. 10, supported by said corner and having its axles 12.4 in the upper rear corners of the slots 98 as shown. Thereafter further forward movement of the frame 16 causes the roller to tip forwardly and roll over said corner, thereby falling with one of its lobes 12.2 flat on the ground, to deliver an impact to the ground. In falling forward, the axle 12.4 of the roller moves downwardly until it is once again located above the horizontal portion of the lower part of the periphery of the slot 98. Further forward movement of the frame causes cyclic repetition of the raising of the roller axis, coupled with rolling of the roller and successive impacts which are delivered to the ground.

The paths of the restraint pads 60 on the end faces of the rollers 12 of FIGS. 1, 7 and 9 are shown by reference numeral 90, and are shown substantially circular, being curved about the roller axis 12.1. However, it will be appreciated that these paths, as with the path in FIG. 10, need be no more than approximately circular. It is thus necessary to have the restraint pads 60, located, as shown, so that they are always opposed to and facing the end faces of the roller 12. The end faces of the roller 12 must furthermore be provided with a sufficient area of mild steel lining 12.3, so that the restraint pads 60 are always opposed to said lining.

With reference now to FIG. 11, once again like reference numerals are used to designate like parts unless otherwise specified. The frame is designated 116 and is of composite construction, comprising a pair of sub-frames which are vertically spaced, namely a lower sub-frame 116.1 and an upper sub-frame 116.2. These sub-frames have trailing arms respectively 114.1 and 114.2, the rear ends of which are interconnected by cross-members similar to the cross-member 14.1 of FIG. 7, capable of ballasting as described with reference to FIG. 9 to align the centre of gravity of the frame with the roller axis.

The sub-frames 116.1, 116.2 on each side of the compactor are interconnected by a pair of upwardly extending pivotal links 118 spaced in the fore and aft direction. Each link has its lower end pivotally connected to the lower sub-frame 116.1 about a laterally extending axis, and has its upper end pivotally connected to the upper sub-frame 116.2 about a laterally extending axis. Said axes are arranged so that the sub-frames 116.1, 116.2 and links 118 are capable of pivoting about said axes, parallelogram-fashion, thereby to vary the vertical spacing between the sub-frames 116.1 and 116.2.

The sub-frame 116.2 has the stub-axles 12.4 constituting the roller axle journalled therein, said stub axles 12.4 being bolted down by means of straps 12.5.

An arcuately shaped composite leaf spring 120 is provided at each end of the roller between the sub-frames 116.1 and 116.2. Said leaf spring 120 acts resiliently to hold the sub-frames 116.1 and 116.2 apart. Each leaf spring 120 has its central portion fast with and bearing against the lower sub-frame 116.1 at 122. Opposite ends of each leaf spring 120 are provided with rollers 124 which are rollable in the direction of movement 34 of the assembly along platforms or tracks 126 provided therefor on the upper sub-frame 116.2.

The assembly 10 of FIG. 11 has restraint pads 60 which are similar in construction, arrangement and function to those described with reference to FIGS. 1 to 6.

The composite frame 116 is suspended from the roller stub axles 12.4, and forward movement of said frame 116 in the direction of haul 34 will initially cause upward and forward pivoting of the links 118 about their pivotal connections to the sub-frame 116.2 to reduce the spacing between the sub-frame 116.1 and 116.2, together with flexing of the springs 120 which causes the rollers 124 of each spring to move away from one another in opposite directions away from the roller axis 12.1. A position is thereafter reached where the force required further to flex the spring 120 is such that, instead of such further flexing, the roller 12 starts to roll in a forward direction.

Figure 11:
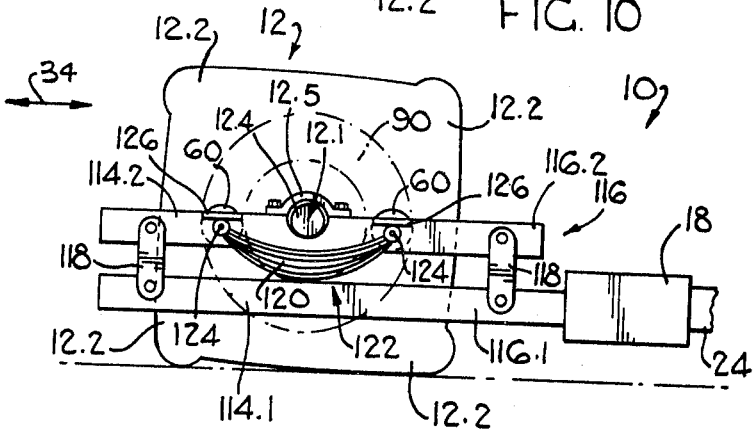
FIG. 11 shows in side elevation yet another embodiment of a compaction roller assembly in accordance with the invention.

As the roller rolls upwardly and forwardly over its front corner engaging the ground, the spring 120 tends to unflex and to return to the position shown in FIG. 11, the links 118 similarly tend to revert to their vertical position as shown in FIG. 11. This process is cyclically repeated during rolling of the roller, the parallelogram defined by the sub-frames 116.1 and 116.2 and the links 118 continually changing in shape together with flexing of the spring 120 and variation in the spacing between the sub-frames 116.1 and 116.2. Further operation of the assembly 10, in particular the operation of the restraint pads 60 is as described with reference to FIGS. 1 to 6.

Figure 12:
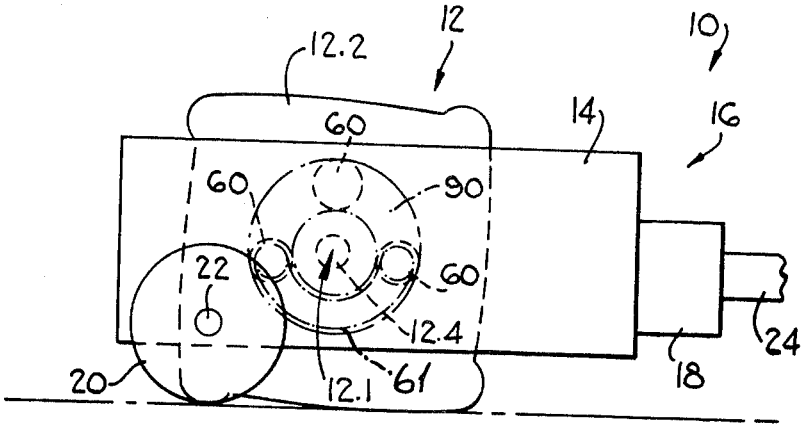
FIG. 12 shows a detail of a different possible arrangement of the restraint pads in FIG. 7.

In FIG. 12 a variation of the restraint pad arrangement is shown, and like reference numerals again refer to like parts unless otherwise specified. Instead of two pads 60 on each side of the assembly 10 as described above, spaced in the fore and aft direction in front of and behind the axle 12.4 respectively and at substantially the same elevation, three restraint pads 60 are shown arranged in an equilateral triangle. The lower pads are at the same elevation below the axle 12.4 and the upper pad is located directly above the axle. The arrangement thus provides for substantial resistance to twisting of the roller 12 about an axis parallel to the direction of movement, i.e. acts to keep the roller axis substantially horizontal by virtue of the vertical spacing between the upper pad and lower pads, in addition to preventing twisting of the roller about a vertical axis thereby to keep the axis normal to the direction of movement by virtue of the fore and aft spacing of the lower pads. Furthermore, although three pads are shown arranged in a circle about the axle 12.4, it will be appreciated that four or any desired greater number can be used instead, and that they need not necessarily be equally spaced in series about the axle or necessarily equidistant from the axle.

A yet further possibility shown in FIG. 12 is to replace the several small pads 60 shown at each end of the roller by a single larger pad at each end of the roller. In FIG. 12 this single pad is shown at 61, and is of elongated arcuate or cresent shape. It is curved about the axle 12.4 and extends about 180° around the axle as shown. The pads 61 can be of similar construction to the pads 60 as described above to permit similar replacement and lubrication.

Figure 13:
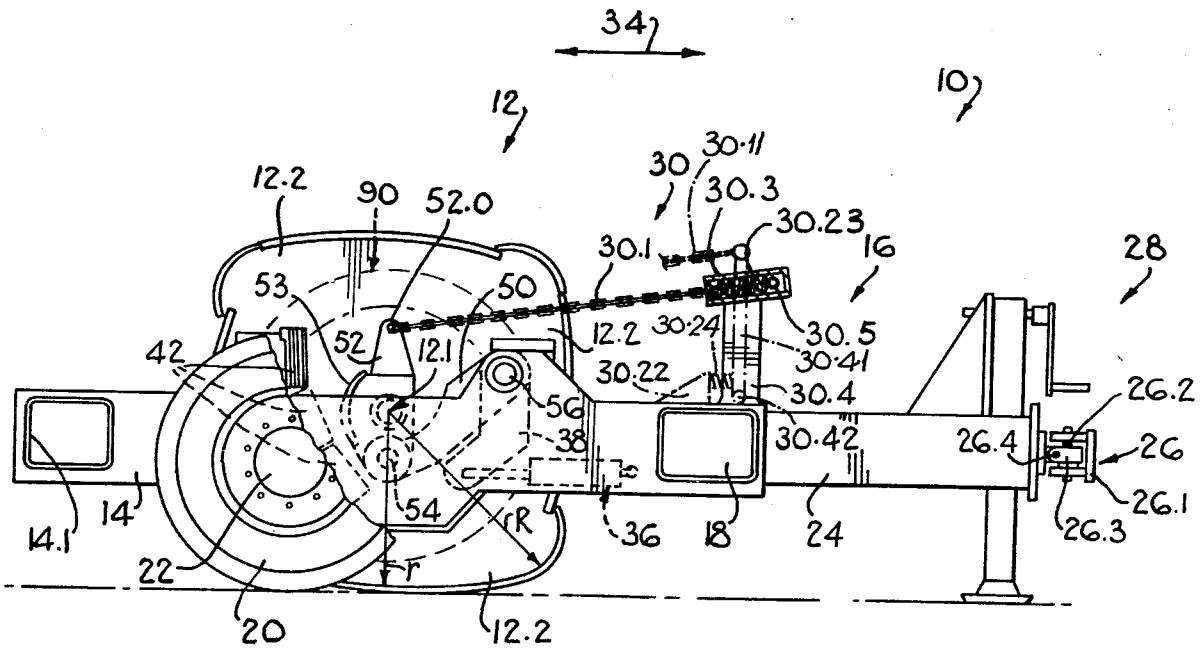
FIG. 13 shows a side elevation of a compaction roller assembly having a multi-lobed non-circular compaction roller mounted according to still another embodiment of the invention.
Figure 14:
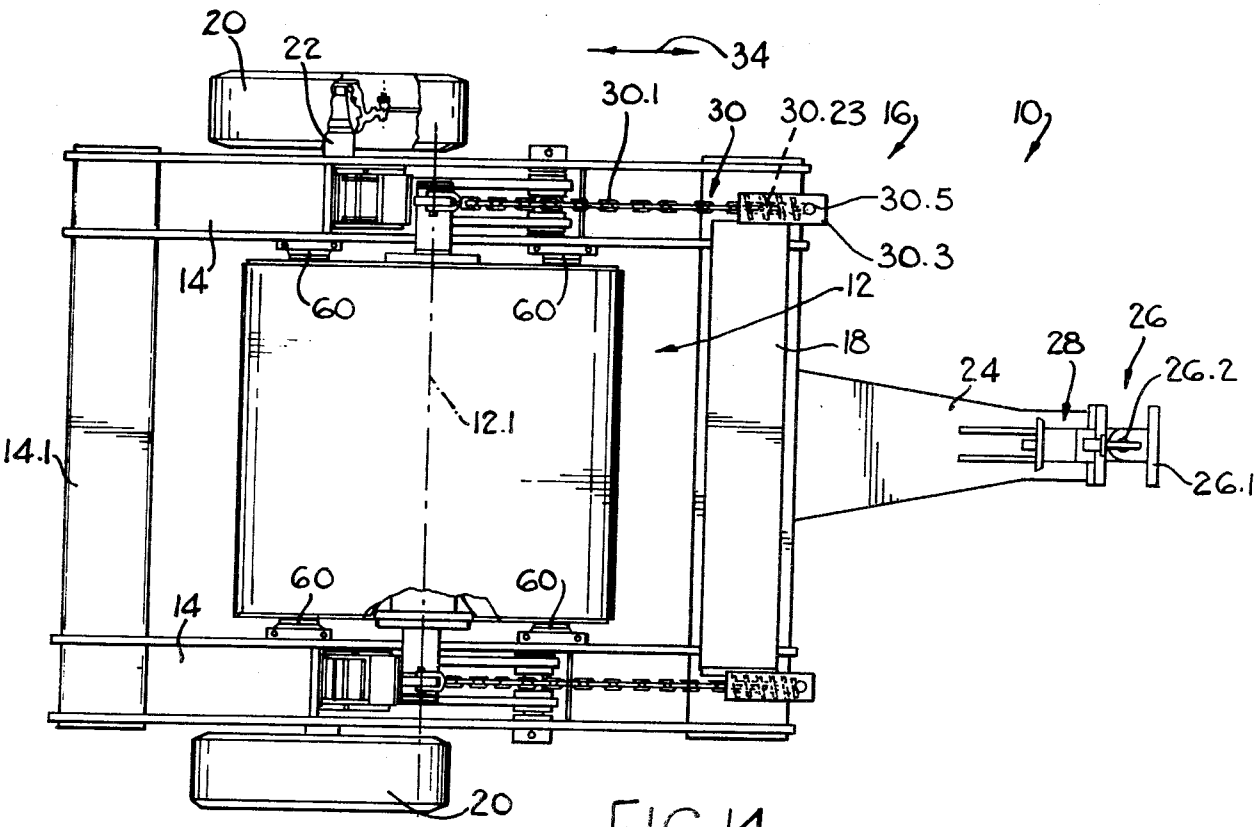
FIG. 14 shows a plan view of the roller of FIG. 13.

In FIGS. 13 and 14 once again, unless otherwise specified, like reference numerals refer to like parts. FIGS. 13 and 14 are substantially similar to FIGS. 1 and 2 except that the tractive connection between the roller 12 and the frame 16, by means of the pair of laterally spaced links 30, is somewhat different. Instead of the torsion bars, rigid links 30.2 and cables 30.1, each link 30 comprises a flexible element in the form of a chain 30.1, and a coil spring 30.23. Each coil spring 30.23 is mounted in a cylindrical housing 30.3, located at the top of a post 30.4. The posts 30.4 project upwardly respectively from positions near the ends of the transverse member 18. Each chain 30.1 is connected to the associated coil spring 30.23 by a swivel 30.5 located at the end of the spring 30.23 remote from the roller 12. Each chain 30.1 passes from its swivel 30.5 along the interior of the associated spring 30.23, and out through an opening at the end of the housing 30.3 which is directed towards the roller 12. The end of the spring 30.23 remote from the swivel 30.5 is anchored to the post 30.4 by abutting against said end of the housing 30.3 through which the chain 30.1 passes.

Each chain 30.1 is connected to a respective one of the links 52 and in operation the assembly 10 of FIGS. 13 and 14 is basically similar to that of FIGS. 1 and 2. The coil springs 30.23 cushion tractive effort between the frame 16 and the roller 12 in the direction of arrow 34, and the buffer stops 42 act to prevent or reduce overstraining of the springs 30.23 or damage in the event of breakage of the springs 30.23 or chains 30.1.

In a further possible construction each post is shown in FIG. 13 in chain dotted lines at 30.41, pivotally mounted at 30.42 on the frame about a lateral axis. In this construction each chain is designated 30.11 and is pivotally attached to the top of the corresponding post about a lateral axis. The coil springs are designated 30.24 and are located behind the posts 30.41, between said posts respectively and associated forwardly facing abutments 30.22 mounted on the frame behind posts 30.41. The function of the posts 30.41 and springs 30.24 is essentially similar to the function of the posts 30.4 and springs 30.23.

The assemblies shown in FIGS. 15 to 17 inclusive will now be described, and unless otherwise specified, the same reference numerals are again used for the same parts.

Figure 15:
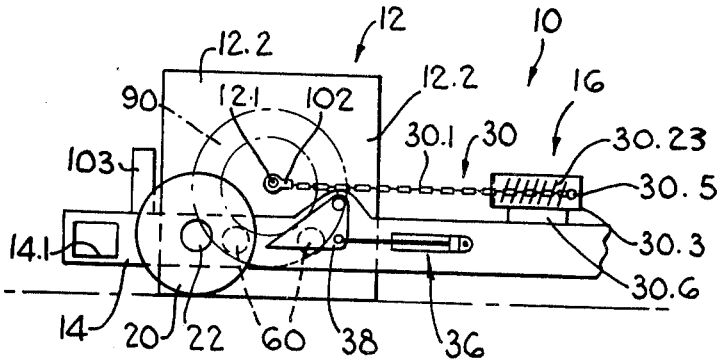
FIG. 15 shows diagrammatically a side elevation of another compaction roller assembly in accordance with the invention.

In FIG. 15, the post 30.4 is omitted, and is replaced by a squat pillar 30.6 whereby the housing 30.3 is mounted on the frame 16 so that the chain 30.1 is substantially horizontal. The links 50 and 52 are omitted, and the end of the chain 30.1 remote from the spring 30.23 has the roller axle 12.4 journalled directly thereto by means of a eye formation 102. The remaining construction and use of the roller of FIG. 15 are substantially similar to the use and construction described with reference to FIGS. 1 to 6, 13 and 14, the assemblies 36 being operable to bear upwardly via the levers 38 against abutments provided by the eye formations 102, thereby to raise the roller 12 from the ground. If desired, abutments 103 can be provided on the arms 14 of the frame, as a safety feature for engagement with the corresponding eye formation 102 on the roller axle, in the event of a breakage of one or both of the chains 30.1.

Figure 16:
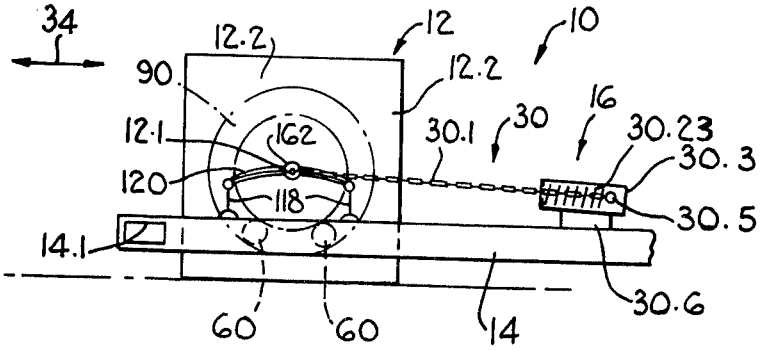
FIG. 16 shows diagrammatically in side elevation yet another embodiment of a compaction roller assembly in accordance with the invention.

In FIG. 16, the housing 30.3 is once again mounted on a pillar 30.6 so that the chain 30.1 is substantially horizontal. The eye formations 102 wherein the roller axis 12.1 is journalled are connected to the central parts of two substantially horizontal composite leaf springs 120. Each leaf spring 120 extends in the fore and aft direction, and opposite ends of each leaf spring are pivotally connected, about lateral axes, respectively to downwardly extending pivotal links 118. The lower ends of the links 118 in turn are pivotally connected about lateral axes to the corresponding arms 14 of the frame 16.

The cross-member 14.1 of the frame 16 of FIG. 16 is hollow, and is provided with means whereby liquid or particulate ballast may be charged therein, thereby to vary the location of the centre of gravity of the frame 16 in the fore and aft direction. In use the centre of gravity of the frame 16 is located as close as possible to the position in which it is intersected by a vertical plane in passing through the roller axis 12.1.

From FIG. 16 it is apparent that the frame 16 is hung from the roller axis 12.1, and that there are no wheels 20 and no elevator means 36. Pivoting of the links 118 permits relative movement between the roller axle 12.4 and the frame 16 parallel to the fore and aft direction shown by arrow 34, and the leaf springs 120 ensure that the frame 16 is resiliently suspended from said roller axle.

With regard to FIGS. 15 and 16, two restraint pads 60 are shown mounted on the frame at each end of the roller 12, the restraint pads 60 being constructed and operating in substantially the same way as described with reference to FIGS. 1 to 6, and being slidable along the paths 90 at the ends of the roller.

Figure 17:
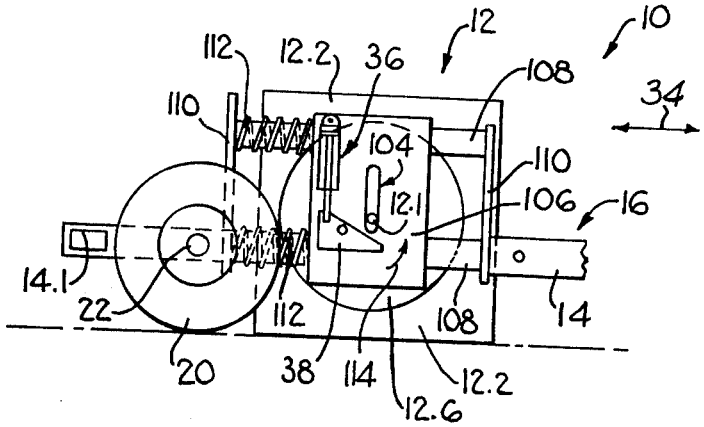
FIG. 17 shows diagrammatically in side elevation a still further embodiment of the compaction roller assembly in accordance with the invention.

With reference to FIGS. 17, the chain 30.1 and spring 30.23 are omitted entirely. Instead, each end of the roller axle is located in an upwardly extending slot 104 in a slide member 106. Each slide member 106 is slidable in a direction parallel to the direction of movement shown by arrow 34, along a vertically spaced pair of substantially horizontal guides 108. The guides 108 form part of the frame 16, each pair of guides 108 forming part of one of the arms 14.

The upper guide 108 is held above the correponding lower guide 108 by a pair of longitudinally spaced posts 110. A pair of coil springs 112 is associated with each pair of guides 108, each spring 112 being located around the associated guide 108 between the corresponding slide member and the rear post 110. The springs 112 thus act as resilient stop means limiting the degree to which the slide member 106 can slide rearwardly along the guides 108.

The wheels 20 are mounted via the axles 22 on the arms 14, rearwardly of the rear post 110.

The elevator means comprises a pair of downwardly extending piston and cylinder assemblies 36, the assemblies 36 being mounted respectively on the slide members 106, each cylinder of the assembly having its free end pivotally mounted at the top of the associated slide member 106 about a lateral axis, and the piston projecting downwardly from the cylinder and having its free end pivotally connected about a lateral axis to the associated lever 38, which is likewise pivotally mounted on the corresponding slide member 106 about a laterally extending pivot axis.

The assemblies 36 are extensible to pivot the levers 38 in the direction of arrow 114 thereby to engage and raise the roller axle, to lift the roller 12 from the ground.

Use of the assembly 10 of FIG. 17 is similar to that described with reference to FIGS. 1 to 6. During rolling of the roller 12 along the ground, the axle moves up and down in the confines of the slots 104, and the slide member 106 moves backwardly and forwardly in the direction parallel to arrow 34 along the guides 108. The springs 112 resiliently limit the degree to which the slide-member 106 can move rearwardly along the guides, and the front post 110, when necessary, limits the extent to which the slide member 106 can move forwardly along the guides 108. If desired, additional coil springs may thus be provided as buffers between the front posts 110 and the slide member 166, these additional coil springs being arranged so that they are not engaged by the slide member 106 during normal operation of the assembly 10, and do not interfere with normal rolling of the roller in the frame.

In the assembly shown in FIG. 17, each slide member 106 acts as a restraint member or the slide members can have restraint pads mounted thereon and engaging the roller, in the fashion of FIGS. 1 to 6. At each end of the roller 12, the roller has a raised circular plateau concentric with the roller axis 12.1. The plateaus are designated 12.6 and present circular flat laterally outwardly facing surfaces around the ends of the roller axle.

Each slide member 106 correspondingly has a flat, laterally inwardly directed roller-engaging face, and the guides 108 with their springs 112 are arranged so that the roller engaging faces of the slide members are constantly located where they can bear inwardly against and engage with the outwardly facing surface 12.6.

The assembly 10 has a metering pump of the type described with reference to FIGS. 1 to 6, and the slide members 106 are provided with one or several mutually spaced socket connections similar to the connections 72 described with reference to FIGS. 1 to 6, via which the metering pump is adapted to deliver lubricant to the plateau surfaces 12.6 under the roller engaging faces of the slide members 106.

The surfaces 12.6 and the inwardly facing roller engaging faces of the slide member 106 are of mild steel, and the lubricant in use is spread over substantially the whole of the common area of engagement between said surfaces 12.6 and the slide members. The extent of the surfaces 12.6 and the size of the slide members 106 is such that engagement between said surfaces 12.6 and slide members 106 tends to keep the roller in the desired attitude, in which its axle is substantially horizontal and is substantially normal to the direction of movement 34. In this regard it will be appreciated that the guides 108 keep each slide member 106 in a position such that its laterally inwardly facing roller engaging surface is substantially vertical, and if necessary, the rear posts 110 and front posts 110 can be spaced further apart than shown so that the upper ends of the posts 110 on one side of the assembly can be connected respectively by cross-beams to the upper ends of the posts 110 on the other side of the assembly, the spacing between the front and rear posts being such that the beams are not fouled by the roller 12 during use.

Figure 18:
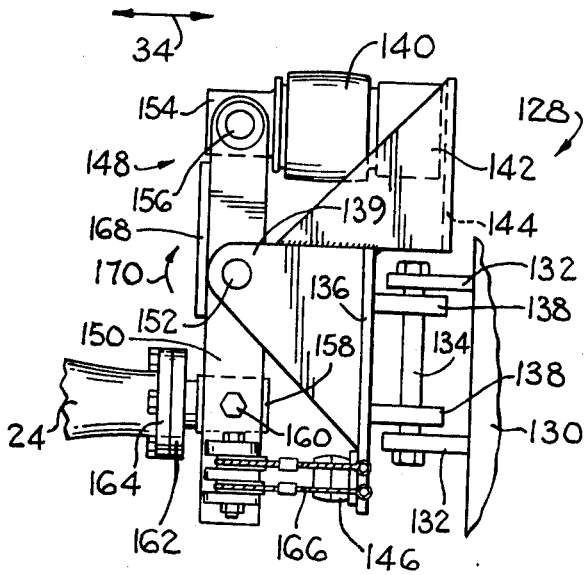
FIG. 18 shows a detail of different connection means suitable for connecting the assemblies of FIGS. 1, 2, and 7 to 17 to a draught vehicle.

The detail of the alternative connection means in FIG. 18 is generally designated 128. The rear of the draught vehicle is shown at 130 having a pair of vertically spaced eyes 132 through which passes a pin 134. The connection means 128 includes a metal bracket 136 which has a pair of vertically spaced eyes 138, through which the pin 134 also passes. The bracket 136 has a pair of upright side edges which are provided with triangular rearwardly extending flat metal ears 139 the bases of which are fast with said side edges and the apices of which project rearwardly so that the ears are in upright opposed parallel relationship, parallel to the direction of movement 34.

A pneumatic resiliently flexible rubber cushion 140 is mounted above bracket 136. This mounting is by means of a pair of spaced opposed parallel plate gussets 142, each gusset having its lower edge butt welded to the upper horizontal edge of one of the ears 139. The front edges of the gussets, which are vertical and parallel, are interconnected by a flat upright plate 144, on the rearwardly directed face of which the cushion 140 is mounted. The cushion 140 projects rearwardly from the plate 144 between gussets 142, and a horizontal row of rubber buffers 146 is mounted on the lower portion of the bracket 136 to project rearwardly therefrom below the ears 139.

A rectangular metal frame 148 comprising a pair of uprights 150, the lower ends of which are rigidly connected by a cross-member (not shown) opposed to the buffers 146, is pivotally mounted on the ears 139 about lateral axis 152. A metal anvil 154 is pivotally connected to the frame 148 between the upper ends of the uprights 150 about lateral axis 156 and is opposed to the cushion 140. A bar 158 is pivotally connected to the frame 148 between the uprights 150 about lateral axis 160, and axis 160 is located between the cross-member and the axis 152. A rearwardly facing disc 162 is carried by the bar 158 and is bolted to a disc 164 at the front end of the tongue-like projection 24 of the assembly 10. Cables 166 respectively connect the frame 148 at opposite ends of the cross member to the bracket 136 at its lower corners. The uprights 150 are further interconnected by a plate 168 which strengthens the frame 148.

In use, during turning of the draught vehicle and assembly 10, the draught vehicle and assembly 10 can pivot relative to each other about the upwardly extending axis constituted by the pin 134. Traction from the draught vehicle is transmitted to the assembly 10 via the pin 134, bracket 136 and ears 139, and via the frame 148. when the draught vehicle moves forwardly faster than the assembly, the frame 148 pivots about axis 152, in the direction of arrow 170, causing the anvil 154 to compress the cushion 140, the anvil 154 pivoting about axis 156 to remain properly aligned with the cusion 140. Cables 166 prevent excessive compression of the cushion 140 by said anvil 154.

When the assembly 10 outruns the draught vehicle, the cross-member interconnecting the lower ends of the uprights 150 strikes the buffers 146, the frame 148 pivoting in the direction opposite arrow 170 about axis 152.

During pivoting of the frame 148 about axis 152 the bar 158 pivots about axis 160. The connection means 128 of FIG. 18 thus provides an extensible connection between the draught vehicle and assembly 10 which buffers shock forces transmitted in the direction of haul between the assembly and draught vehicle, both when the draught vehicle outruns the assembly and vice versa. The connection also permits pivoting of the assembly relative to the draught vehicle about upright and lateral axes and permits limited relative movement between the draught vehicle and assembly in the direction of movement.

Figure 19:
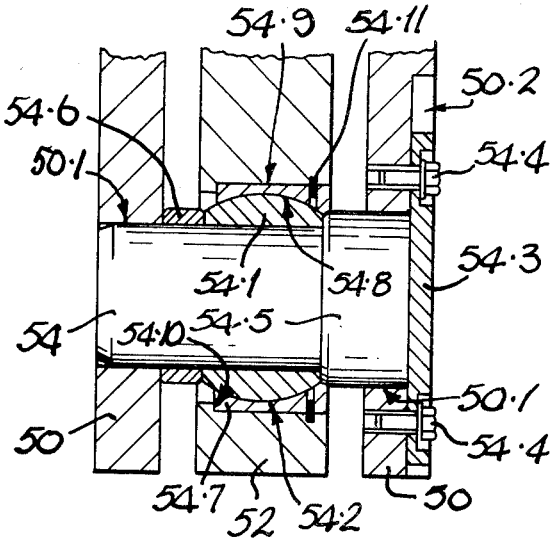
FIG. 19 shows a detail of an alternative joint means for interconnecting the auxiliary links of each auxiliary linkage of the assembly of FIGS. 1 and 2.
Figure 20:
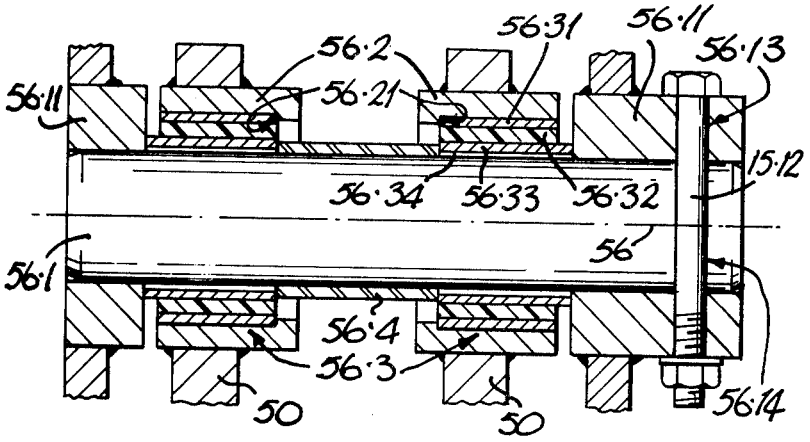
FIG. 20 shows a detail of an alternative joint means for connecting the auxiliary linkages to the frame of the assembly of FIGS. 1 and 2.

For the purposes of FIGS. 1 and 2 the pivotal connections between the links 50 and 52, and the pivotal connections between the links 50 and the arms 14 have been described as simple pivotal connections, permitting only pivoting in a single plane about the axes the pins 54 on the one hand, and about the axes 56 on the other hand. With reference to FIGS. 19 and 20 below, more complex pivotal connections are described as modifications to FIGS. 1 and 2, which permit more complex pivoting.

With reference to FIG. 19, the same reference numerals are used for the same parts unless otherwise specified. The axis between the links 50 and 52 is provided by a pin 54 having a collar 54.1 around it with a convex part-spherical working surface 54.2 thereon. The pin 54 is held in passages 50.1 in laterally spaced parts of the link 50 by a bar 54.3 bolted in a slot 50.2 in one of said spaced parts by bolts 54.4. The pin 54 has a slotted head 54.5 which receives the bar 54.3 to prevent rotation of the pin relative to the link 50. The head 54.5 together with an annular spacer 54.6 acts to locate the pin 54 and the collar 54.1 in position between said parts of the link 50. A sleeve bearing 54.7 having a concave part-spherical working surface 54.8 is held in a passage 54.9 in the link 52 against a shoulder 54.10 by means of a circlip 54.11. The swivel type joint thus provided permits (by allowing variation of the attitude of the axis of pin 54 relative to the link 52) universal-joint-type alteration of the attitude or inclination of the roller axis 12.1 relative to the frame 16, both relative to the direction of movement and relative to the vertical, in response to movements of the roller other than mere rotation about the roller axis, caused by rolling over uneven ground.

With reference to FIG. 20, once again the same reference numerals are used unless otherwise specified. The axis 56 is provided by a pin 56.1 located in collars 56.11 provided in spaced apart parts of the associated arm 14. The pin 56.1 is held in place by a bolt 56.12 passing through registering passages 56.13, 56.14 in one of the collars 56.11 and in the pin 56.1 respectively. The spaced apart parts of the link 50 (shown also in FIG. 19) are provided at the end of said link 50 remote from the axis of pin 54, with collars 56.2. Each collar 56.2 has a shoulder 56.21, the shoulders 56.21 facing oppositely away from each other and against which collars abut sleeve-type bearings 56.3. Each bearing 56.3 is composite and comprises, fast with one another and arranged concentrically, an outer annular metal cylinder 56.31, an intermediate annular cylinder 56.32 of rubber or a similar resiliently flexible material, and an inner annular metal cylinder 56.33 provided with a working surface 56.34. The cylinders 56.31 abut the shoulders 56.21, and the cylinders 56.33, which are spaced from each other by a sleeve-type spacer 56.4, abut the collars 56.11. The working surface 56.34 (as is the working surface 54.8 in FIG. 19) is provided by some suitable bearing material such as phosphor-bronze. Flexing of the cylinders 56.32 permits variation of attitude of the axis 56 of the pin 56.1 relative to the link 50 and thus assists arrangement of FIG. 19 in permitting alteration of the attitude or inclination of the roller axis 12.1 relative to the frame 16, both relative to the direction of movement and relative to the vertical.

Although the main advantage of the invention, as described hereunder, is that the restraint means acts to keep the roller in a desired constant attitude and lateral position relative to the frame, and although the modifications shown in FIGS. 19 and 20 permit the roller axis and hence the roller to vary its attitude and inclination relative to the frame, the functions of the restraint means and said modifications are not contradictory. It will be appreciated in this regard that while the restraint means confines misalignment of the frame relative to the roller between narrow limits, the modifications of FIGS. 19 and 20 tend to prevent any such small misalignments as may be permitted by the restraint means from straining the bearings and/or links between the roller and frame. The restraint means and the modifications of FIGS. 19 and 20 thus tend to reinforce one another in reducing strain caused to the bearings or to the connection between the frame and roller caused by undesired movement of the roller, i.e. twisting of the roller or movement of the roller in the direction of its axis, relative to the frame, and they thus tend to reduce damage caused to said bearings or connection by the undesired movement.

An advantage of the invention is that the restraint pads 60 keep the roller 12 in a desired constant attitude relative to the frame 16, with the axis 12.1 horizontal and normal to the direction of haul, thereby reducing the strain imposed on the linkages between the frame and the roller in operation, particularly during turning and when operating on uneven terrain. The pads are wearing parts which can easily and inexpensively be replaced, and the thickness and quality of the lining against which the pads bear can be made to be such that the casing needs replacement at relatively long intervals. Furthermore, in this regard, it will be appreciated that the path 90 of the pads on the roller ends shown in the drawings is shown concentric with the roller axis 12.1 merely for simplicity. In practice the path 90 is neither necessarily concentric with the roller axis 12.1 nor is it necessarily circular. Because of up and down movement of the roller axis relative to the pads, which are fixed to the frame, during operation, the paths 90 will only be more or less circular and concentric with the axis 12.1. This is an advantage as it spreads wear over a wider area of the roller end linings, leading to less frequent damage and repair thereto.

As a measure of the value of the invention, prior to the use of the pads, the average interval between breakdowns of the linkages was 25 hours. Now with the pads in use, intervals of over 1500 hours between breakdowns are the average. Lost down time of expensive machinery is thus substantially reduced.

I claim:

1. A method of operating a compaction roller assembly comprising a draw frame and a non-circular lobed compaction roller connected via its axle to the draw frame such as to follow the draw frame when the draw frame is propelled, which method comprises at least intermittently slidingly engaging at least one end of the roller during rolling of the roller as it follows the frame when the frame is propelled, by restraint means which is mounted on the frame and which engages the roller at a position spaced from the roller axis, thereby to restrain undesired movement of the roller relative to the frame.

2. A method as claimed in claim 1, in which the restraint means comprises a plurality of restraint members, the restraint members engaging the roller at at least two positions spaced from the roller axis.

3. A method as claimed in claim 2, in which said positions are spaced in the direction of movement of the frame from the roller axis such that the restraint members act to restrain the roller from twisting relative to the frame and thereby departing from an attitude in which its axis is perpendicular to said direction of movement.

4. A method as claimed in claim 2, in which said positions are vertically spaced from the roller axis such that the restraint members act to restrain the roller from twisting relative to the frame and thereby departing from an attitude in which its axis is horizontal.

5. A method as claimed in claim 2, in which the restraint members slidingly engage the roller at at least three positions spaced from the roller axis.

6. A method as claimed in claim 5, in which the restraint members are mounted on the frame at positions which are equally spaced from the median position of the roller axis.

7. A method as claimed in claim 1, which comprises lubricating the sliding engagement between the restraint means and the roller by means of a suitable lubricant.

8. A method as claimed in claim 7, in which the lubricant is a fluid lubricant having a kinematic viscosity in the range of 220–435 centistokes at 37½° C.

9. A method as claimed in claim 7, which includes, during rolling of the roller, at least intermittently supplying the lubricant to the engagement between the restraint means and the roller.

10. A method as claimed in claim 9, which includes controlling the rate of supply of lubricant by control means which is responsive to changes in the speed of rolling of the roller.

11. A method as claimed in claim 9, in which the lubricant is fluid supplied by a metering pump.

12. A method as claimed in claim 1, in which the restraint means at least intermittently engages each end of the roller.

13. A compaction roller assembly which comprises a draw frame;

a non-circular lobed compaction roller connected via its axle to the draw frame such as to follow the draw frame when the draw frame is propelled; and restraint means mounted on the frame and slidably engagable, during rolling of the roller as it follows the frame when the frame is propelled, with at least one end of the roller at a position spaced from the roller axis, thereby to restrain undesired movement of the roller relative to the frame.

14. An assembly as claimed in claim 13, in which the restraint means comprises a plurality of restraint members, the restraint members being mounted on the frame and arranged so that they are engagable with the roller at at least two positions spaced from the roller axis.

15. An assembly as claimed in claim 14, in which said positions are spaced in the direction of movement of the frame from the roller axis such that the restraint members act to restrain the roller from twisting relative to the frame and thereby departing from an attitude in which its axis is perpendicular to the said direction of movement.

16. An assembly as claimed in claim 14, in which said positions are vertically spaced from the roller axis such that the restraint members act to restrain the roller from twisting relative to the frame and thereby departing from an attitude in which its axis is horizontal.

17. An assembly as claimed in claim 14, in which there are at least three said restraint members, engageable with the roller at different positions.

18. An assembly as claimed in claim 14, in which the positions of the restraint members are equally spaced from the median position of the roller axis.

19. An assembly as claimed in claim 14, in which there is at least one restraint member engageable with each end of the roller.

20. An assembly as claimed in claim 14, in which the restraint members are pads replaceably held in brackets on the frame.

21. An assembly as claimed in claim 20, in which the pads are of mild steel, having flat working surfaces for engagement with the roller, each end of the roller which is engageable by a pad having a mild steel outer lining covering at least that part of the roller end with which the pad in use is engageable.

22. An assembly as claimed in claim 13, which includes lubricating means for supplying a lubricant to the roller where the restraint means engages the roller.

23. An assembly as claimed in claim 22, in which the lubricating means comprises a metering pump for pumping the lubricant to the roller.

24. An assembly as claimed in claim 23, in which the metering pump is capable of pumping a lubricant having a kinematic viscosity in the range of 220–435 centistokes.

25. An assembly as claimed in claim 23, in which the metering pump is of variable capacity.

26. An assembly as claimed in claim 23, in which the metering pump is operatively connected to control means responsive to the speed of rolling of the roller for supplying lubricant at a faster rate when the roller is rolling quickly, than when the roller is rolling slowly.

27. An assembly as claimed in claim 23, in which the metering pump has its intake connected to a lubricant store mounted on the assembly.

28. An assembly as claimed in claim 13, in which the connection between the roller axle and the frame comprises a pair of simple links, the links being located at opposite ends of the roller and each link having one end connected directly to the frame and having the roller axle journalled to its other end.

29. An assembly as claimed in claim 13, in which the frame has, at opposite sides thereof, a pair of laterally spaced ground wheels whereby the frame is supportable during rolling of the roller, the frame having at opposite ends of the roller a pair of slots or recesses in which opposite ends of the roller axle are located and within the confines of which the said ends of the roller axle are constrained to move during rolling of the roller.

30. An assembly as claimed in claim 13, in which the frame comprises a pair of sub-frames, one of which is adapted for connection to a draught vehicle and the other of which has opposite ends of the roller axle journalled therein, the sub-frames being vertically spaced from each other and resiliently held apart by biassing means, and the sub-frames being interconnected at each side of the assembly by a pair of pivotal links spaced in the direction of movement of the assembly, each link having its ends respectively connected to the sub-frames and the sub-frames being movable relative to each other by pivoting of the links relative to said sub-frames.

31. An assembly as claimed in claim 13, in which the connection between the roller axle and the frame comprises a pair of links, the links being respectively located at opposite ends of the roller and each link comprising a coil spring mounted on the frame and a flexible element, the flexible elements being located respectively between the coil springs and the ends of the roller axle and the links being resiliently extensible against a bias provided by the springs.

32. An assembly as claimed in claim 13, in which the roller has each end of its axle located in an upwardly extending slot in a slide member, each slide member being slidable along a guide forming part of the frame, parallel to the direction of movement of the frame, and the assembly including resilient stop means limiting the degree to which the slide member can slide rearwardly along its guide.

33. An assembly as claimed in claim 13, in which the connection between the roller axle and the frame comprises a pair of laterally spaced longitudinally extending composite links respectively at opposite ends of the roller and pivotally connected to the frame about primary pivotal axes extending laterally, each composite link comprising at least two constituent links pivotally connected together about secondary pivotal axes parallel to the primary pivotal axes, bias means to bias at least two of the constituent links of each composite link to positions in which they are at an angle to each other, and bearings for the roller on each of the composite links wherein the roller axis is journalled, the connection permitting arcuate displacement of the roller axis independently about the primary and secondary pivotal axes.

* * * * *